US008806819B1

(12) United States Patent
Teilborg et al.

(10) Patent No.: US 8,806,819 B1
(45) Date of Patent: Aug. 19, 2014

(54) REMOVABLE WALL OPENING FRAMES

(71) Applicants: Logan R Teilborg, Chattaroy, WA (US); Charles A Teilborg, Usk, WA (US)

(72) Inventors: Logan R Teilborg, Chattaroy, WA (US); Charles A Teilborg, Usk, WA (US)

( * ) Notice: Subject to any disclaimer, the term of this patent is extended or adjusted under 35 U.S.C. 154(b) by 0 days.

(21) Appl. No.: 13/827,675

(22) Filed: Mar. 14, 2013

(51) Int. Cl.
*E06B 1/04* (2006.01)

(52) U.S. Cl.
CPC ..... *E06B 1/04* (2013.01)
USPC ..... 52/217; 52/204.1; 52/212; 49/505

(58) Field of Classification Search
CPC ..... E06B 1/20; E06B 1/30; E06B 1/18; E06B 1/603
USPC ..... 52/204, 211, 204.1, 212, 217; 49/505
See application file for complete search history.

(56) References Cited

U.S. PATENT DOCUMENTS

| | | | | | |
|---|---|---|---|---|---|
| 1,048,988 | A * | 12/1912 | Mayo, Sr. | 52/212 |
| 2,742,117 | A * | 4/1956 | Tolman | 49/399 |
| 2,853,161 | A * | 9/1958 | Mascari | 52/212 |
| 2,860,744 | A * | 11/1958 | Mascari | 52/212 |
| 3,420,003 | A * | 1/1969 | Cline | 49/505 |
| 3,545,135 | A * | 12/1970 | Lieber | 49/505 |
| 3,571,995 | A * | 3/1971 | Kasprzak | 52/212 |
| 3,861,099 | A * | 1/1975 | Faudree | 52/211 |
| 3,906,671 | A * | 9/1975 | Maldonado | 49/505 |
| 3,943,679 | A * | 3/1976 | Dissinger | 52/473 |
| 4,128,977 | A * | 12/1978 | Schubeis | 52/212 |
| 4,637,183 | A * | 1/1987 | Metz | 52/217 |
| 4,735,025 | A * | 4/1988 | Day | 52/217 |
| 4,782,630 | A * | 11/1988 | Kleyn | 49/505 |
| 4,787,184 | A * | 11/1988 | Boidron | 52/217 |
| 4,791,758 | A * | 12/1988 | Bauer et al. | 49/505 |
| 4,878,325 | A * | 11/1989 | Van Tuyl et al. | 52/217 |
| 4,986,034 | A * | 1/1991 | Mozuras et al. | 49/505 |
| 4,986,044 | A * | 1/1991 | Funari | 52/213 |
| 5,058,323 | A * | 10/1991 | Gerritsen | 49/504 |
| 5,168,669 | A * | 12/1992 | Knapp | 49/482.1 |
| 5,187,898 | A * | 2/1993 | McKann | 49/505 |
| 5,220,748 | A * | 6/1993 | Chadbourne | 49/505 |
| 5,233,802 | A * | 8/1993 | Rogers | 52/212 |
| 5,345,722 | A * | 9/1994 | McKann | 49/505 |
| 5,528,869 | A * | 6/1996 | Boomer et al. | 52/212 |
| 6,286,274 | B1 * | 9/2001 | McKann et al. | 52/204.1 |
| 6,308,476 | B1 * | 10/2001 | Nakamoto et al. | 52/217 |
| 6,550,193 | B2 * | 4/2003 | Potts | 52/204.1 |
| 7,043,883 | B1 * | 5/2006 | Cederberg et al. | 52/204.1 |
| 7,533,503 | B2 * | 5/2009 | Wang | 52/217 |
| 8,069,622 | B2 * | 12/2011 | Mees et al. | 52/213 |
| 8,109,053 | B2 * | 2/2012 | Smith | 52/212 |
| 8,375,660 | B2 * | 2/2013 | Nolan et al. | 52/211 |
| 8,490,350 | B1 * | 7/2013 | Greely et al. | 52/213 |
| 2005/0262798 | A1 * | 12/2005 | Pringle et al. | 52/718.04 |
| 2006/0096203 | A1 * | 5/2006 | Weinstein | 52/288.1 |

* cited by examiner

*Primary Examiner* — Basil Katcheves
*Assistant Examiner* — Joshua Ihezie

(57) ABSTRACT

In one instance, the disclosure is a removable wall opening frame comprising a mounting element and trim element. The mounting element contains a slit receiver and the trim element contains raised slits. The slit receiver of the mounting element and the raised slits of the trim element are configured to lockedly engage the mounting element and the trim element. When engaged, the slit receiver is not visible or accessible. The trim element can be disengaged from the mounting element by inserting a key into a hole in the mounting element. When disengaged, the frame can be removed from the wall opening. Neither the mounting element, trim element, nor wall opening are damaged by removal.

16 Claims, 6 Drawing Sheets z
x inch z
x inch

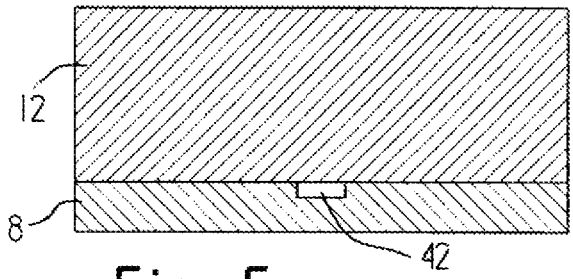
Fig. 5
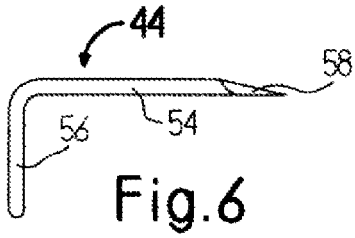
Fig.6
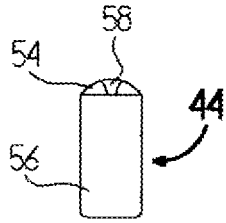
Fig.7
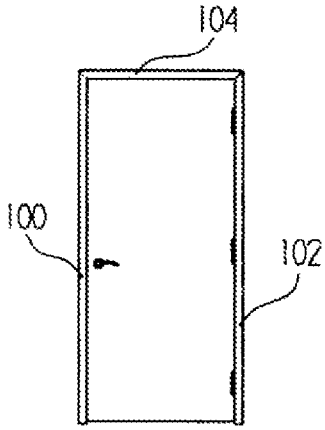
Fig.8
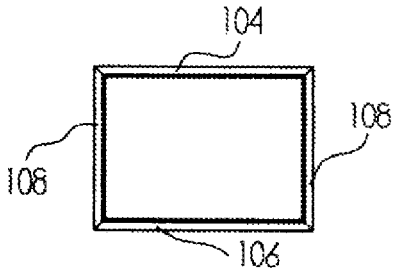
Fig.9
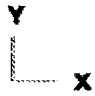
inch

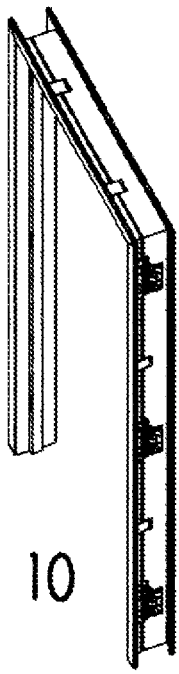
Fig. 10
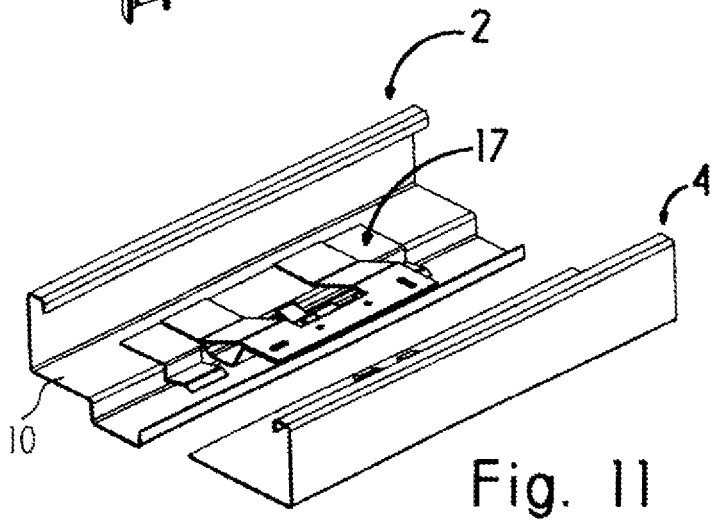
Fig. 11
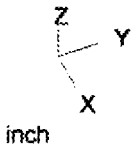

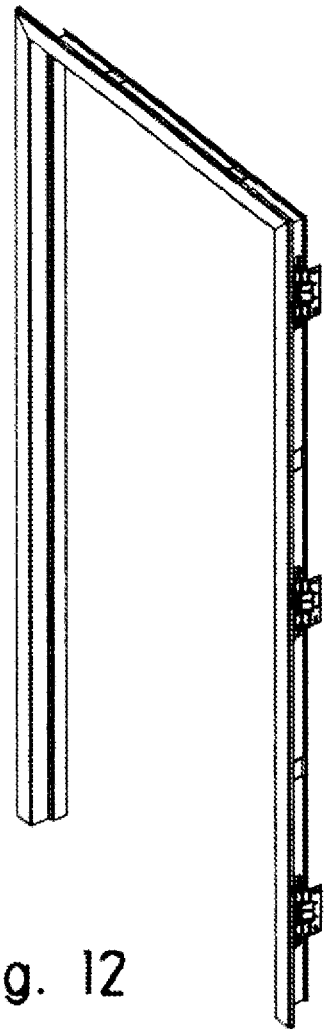
Fig. 12
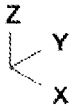
inch inch

REMOVABLE WALL OPENING FRAMES

TECHNICAL FIELD

The present disclosure relates to wall opening frames.

BACKGROUND

Construction firms, and other individuals and entities tasked with installing wall opening frames, are concerned with the cost of materials and labor necessary to install, adjust, and remove such frames. These concerns are shared with the building owner. Typically, the wall opening that needs framing is measured by the construction firm, a frame is ordered to fit the wall opening, and the frame is installed into the wall opening. This technique requires each frame to be custom-made to each wall opening size, resulting in more costly framing and potentially improperly measured frames that must be reordered. In other applications, construction firms will order pre-manufactured frames and construct wall openings to fit those frames. This approach allows firms to order frames in bulk, providing a less costly and time consuming alternative to custom-made frames. However, this approach restrains the construction firm to wall opening sizes that correspond to the pre-manufactured frames. Additionally, pre-fabricating wall frames may be difficult or impractical for applications that require widely varying frame widths and wall materials.

In commercial buildings, the tenants can change frequently, requiring wall opening sizes to be changed and new frames to be installed. To reframe a wall with different wall opening sizes, current frame designs require destruction of the frame or the wall to remove the old frame. Additionally, the typically non-adjustable nature of frames requires firms to purchase an entirely new frame when a different framing application is needed, which can be both costly and time consuming.

Replacement of damaged doors, windows, door frames, and window frames is another common source of cost to the building owner. When only a portion of a frame is damaged, removal of the damaged section, or potentially the entire frame, requires the wall opening frame to be destroyed and rebuilt to replace the frame. For buildings that have large doors, windows, or other framed openings, or buildings with unique wall material, replacing frames using the current framing technology can be expensive.

An additional concern when framing wall openings is safety and security. Frames are ideally installed to make unauthorized access to buildings difficult, thereby increasing safety and security. To accomplish this goal, common frames are fastened to the interior building materials of a wall and then the exterior of the wall is built up around the frame and interior portion. By so doing, the exterior of the wall does not allow access to the fastening mechanisms and thereby discourages unauthorized access by not allowing intruders to undo those fasteners. However, the drawback of this design is that when a frame needs to be removed, destruction of the exterior wall or the frame itself is required to access the fastening mechanisms.

Another safety and security concern exists when doors or windows are being replaced or altered. While the door or window is not mounted on the wall, the risk of unauthorized access to the interior of the building increases. Today's framing designs require construction firms to measure the wall opening, order the frame, and then wait until the framing materials arrive to install the frame and secure the building. If pre-manufactured framing materials were readily available that could be used regardless of the wall opening size, the amount of time the building would be unsecure would be diminished.

The current framing designs, therefore, impose either costly custom installation or installation limited by standard pre-manufactured dimensions, and do not allow for adjustability or removability without partial or complete destruction of the wall opening or the frame.

SUMMARY OF THE DISCLOSURE

Addressing drawbacks of the prior art, the present disclosure provides pre-manufactured frames that can be used with a variety of wall opening dimensions and wall materials. Additionally, embodiments of the frames disclosed herein allow for adjustability and removability without the need to destroy the walls or the frames, instead allowing the frames to be reused in the new application. Furthermore, embodiments of the frames provide a high level of safety and security by enclosing the fastening mechanisms within the frame. These frames may allow construction firms to reduce the cost of materials and labor needed to frame wall openings, decrease the cost to building owners whose tenants require differing wall opening sizes and thus different framing applications, and decrease the time during adjustment and replacement of wall frames, thereby increasing building safety and security.

The present disclosure provides two-part wall opening frames that easily attach together. One part of the frame attaches to wall opening and can be used on substantially any size wall opening. The other part connects to the first part, providing a complete frame in which a door may be hung. The screws or other fasteners used to attach the first part of the frame to the wall opening are covered and inaccessible once the second part is attached. However, the first and second parts of the frame can be detached by using a key designed to fit into a hole in the first part of the frame to disengage the connecting elements holding the two parts together. Both parts of the frame can be removed and reused in a future application without damage to the frame or the wall. These embodiments can provide frames that are inexpensive, capable of pre-manufacture, installable in a wide range of wall opening dimensions, secure, removable, adjustable, and reusable.

In one embodiment, the present disclosure provides two-part removable wall opening frames that require minimal materials and time for installation, adjustment, and removal from wall openings. One part of the frame, the mounting element, can retain the same dimensions for use with a variety of applications and wall opening sizes, while the other part, the trim element, can be manufactured to frame a wide range of wall thicknesses and wall opening dimensions.

In a further embodiment, the present disclosure provides removable wall opening frames that can be securely fastened to wall openings while simultaneously hiding the fastening mechanism from view and access. A mounting element of the frame can be attached to the wall opening with screws or other fastening mechanisms. A trim element of the frame can then be releaseably attached to the mounting element. When attached to the mounting element, the trim element covers the fastening mechanism from view and access.

In still another embodiment, the present disclosure provides wall opening frames that are removable and reusable with little to no damage to the wall openings or wall opening frames. The wall opening frame comprises a mounting element that is attached to the wall opening, and a trim element that couples with the mounting element. The mounting element may comprise a slit receiver, and the trim element can include raised slits that can fasten to the slit receiver. When force is applied to the trim element in the direction of the slit receiver, the raised slits in the trim element are received in the slit receiver, and compressible prongs in the slit receiver lockedly engage the trim element and the mounting element. Once the mounting element and trim element are lockedly engaged, the frames require substantial destructive force to be removed unless the entity removing the frames has the required removing key to disengage the mounting element from the trim element. In one embodiment, to remove the frames with the removing key, the removing entity must first obtain access to the door or window set into the frame. Once the door or window has been opened or removed, the removing key hole, located on the mounting element can be accessed. The removing key can be pushed into the removing key hole, passing by a guiding element that can direct the removing key toward the compressible prongs of the slit receiver, compressing the compressible prongs until the raised slits in the trim element disengage from the compressible prongs. Once the raised slits disengage from the compressible prongs, the trim element of the frames can be pulled away from the mounting element. The trim element is in substantially the same condition as before installation or when installed. The fastening mechanism from the mounting element is then exposed and the fasteners can be removed, if necessary. Once the fasteners are removed, the mounting element can be removed from the wall opening. The mounting element is in substantially the same condition as before installation or when installed.

In these and other embodiments, the present disclosure will become more readily appreciated and understood from a consideration of the following detailed description of the exemplary embodiments of the present disclosure when taken together with the accompanying drawings.

BRIEF DESCRIPTION OF THE DRAWINGS

FIG. 5 shows a side view of the mounting element depicted in FIG. 1.

FIG. 6 shows a cross-sectional view of a removing key.

FIG. 7 shows a frontal view of the removing key depicted in FIG. 6.

FIG. 8 shows a frontal view of a door and door frame.

FIG. 9 shows a frontal view of a window and window frame.

FIG. 10 shows a prospective view of a mounting element and a trim element that have been lockedly engaged, forming a door frame.

FIG. 11 shows a prospective view of a mounting element containing a slit receiver.

FIG. 12 shows a prospective view of a mounting element.

DETAILED DESCRIPTION

Figure 1:
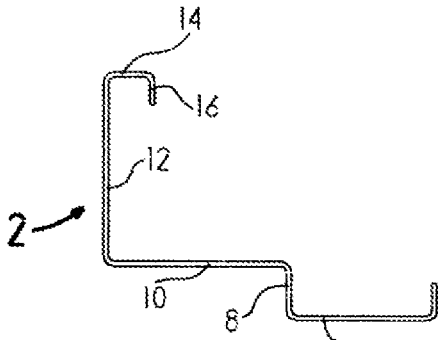
FIG. 1 shows a cross-sectional view of a mounting element.
Figure 2:
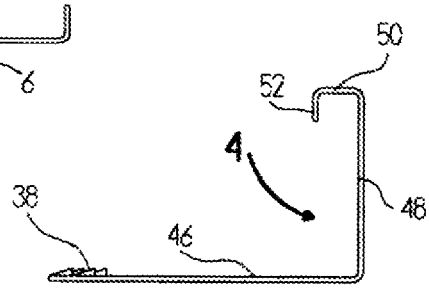
FIG. 2 shows a cross-sectional view of a trim element.

As can be seen in the embodiments shown in FIGS. 1-13, the removable wall opening frames may comprise at least two main elements, the mounting element 2 (FIG. 1) and the trim element 4 (FIG. 2). Both the mounting element 2 and trim element 4, when engaged (FIG. 10), can make up the three sides of a door frame or the four sides of a window frame. As used herein, a door frame frames an opening that extends to the floor (whether or not a door is provided within the frame) whereas a window frame frames an opening that does not extend to the floor (regardless of whether the wall is internal or external and the frame includes a window or not).

As seen in FIG. 8, a door frame may comprise three portions: a strike jamb 100 that extends vertically along one side of the door opening, a hinge jamb 102 that extends vertically along the side of the door opening opposite the strike jamb 102, and a header 104 that extends horizontally along the top of the door opening from the strike jamb 100 to the hinge jamb 102. The strike jamb 100, hinge jamb 102, and header 104 can be three separate pieces, attached to each other by fastening mechanisms or attached to the wall opening adjacent to one another so as to collectively form the three sides of the door frame. Alternatively, the strike jamb 100, hinge jamb 102, and header 104 can be manufactured as one continuous piece, thereby requiring no fastening mechanism to attach the strike jamb 100, hinge jamb 102, and header 104 together. In the embodiment shown, each of the three portions of the door frame are substantially linear, thereby forming a substantially rectangular door frame when installed. In other embodiments, one or more of the portions may have a non-linear shape. For example, the header 104 may be curved to form an arc in place with the strike jamb 100 and the hinge jamb 102 to accommodate an arch-top door. Alternatively, the header 104 may be curved to form an arc substantially perpendicular to the plane formed by the strike jamb 100 and the hinge jamb 102 to accommodate a curved door, such as a convex or concave radius door.

As seen in FIG. 9, a window frame may comprise four portions extending along the perimeter of the wall opening: a header 104 extending horizontally across the top of the opening, a footer 106 extending horizontally across the bottom of the opening opposite the header 104, and two substantially longitudinal sides 108 extending vertically between the header 104 and the footer 106 on opposite sides of the opening. Again, the portions of a window frame can be separate and require fastening to each other or to the opening, or the window frame can be manufactured to be one or more continuous pieces, with each piece including one or more of the header 104, footer 106, or sides 108.

Window and door frames as described in this disclosure can be placed in any number of wall openings, including but not limited to side light frames, transom frames, relight frames, and mullion frames. The frames disclosed herein can also be combinations of door and window frames. For example, the header 104 of a door frame can also act as the footer 106 of a window frame.

Figure 13:
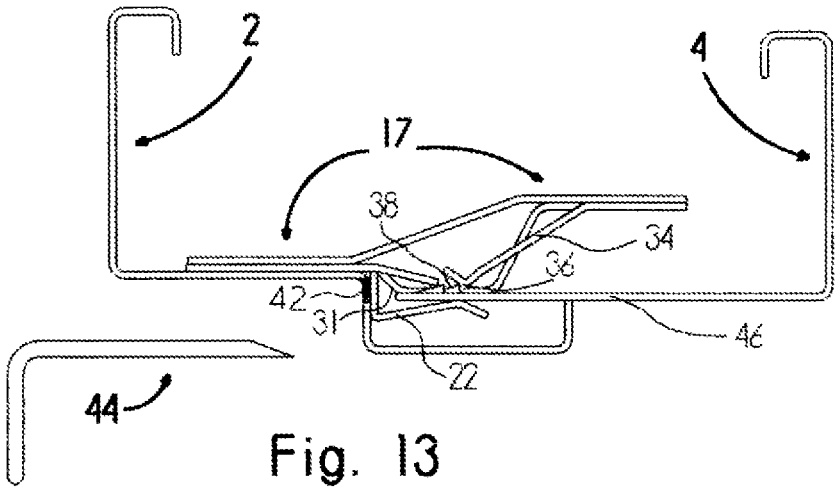
FIG. 13 shows a cross sectional view of a mounting element, a trim element and a slit receiver with a removing key disengaged to lockedly engage the trim element to the mounting element.

When the mounting element 2 is coupled to the trim element 4, the mounting element 2 forms one side of the frame that faces the edge of the wall forming the wall opening, while the trim element 4 forms the other side of the frame that faces the door, when a door is mounted within the frame. The mounting element 2 can be configured to releaseably engage the trim element 4 to couple the mounting element 2 to the trim element 4 to form the complete door frame. The mounting element 2 and trim element 4 can be engaged and disengaged without damaging either (FIG. 13). By configuring the mounting element 2 and trim element 4 to be non-destructively removed, the frame can be re-usable (FIG. 13).

In one embodiment, referring to FIG. 1, the mounting element 2 can comprise multiple portions: a stop 6, which can have an abutment 8, a first rabbet 10, a first trim face 12, and a first return 14, or a first double return 16. The stop 6 can act as a spacer between the interior and exterior of the wall being framed. The abutment 8 can act as a surface for the door to hit when the door is closed. When the stop 6 is used in a window frame construction, the abutment 8 may be described as a keeper and may hold the glass portion of a window into the frame. The first rabbet 10 can act as a support for the first trim face 12, allowing the first trim face 12 to be attached to the abutment 8. The first return 14 can act as a component that prevents a gap between the first trim face 12 and the wall. The first double return 16 can act as support for the mounting element 2 to abut against the wall. In total, the mounting element 2 depicted in FIG. 1 can be made up of components of a generic frame.

Referring to FIG. 11, in one embodiment, a slit receiver 17 can be attached to the interior side of the first rabbet 10. The slit receiver 17 provides a mechanism for the mounting element 2 and the trim element 4 to releasably attach to each other. In other embodiments, any type of non-destructive attachment mechanism that can be detached without damaging the mounting element 2 or trim element 4 can be used.

Figure 3:
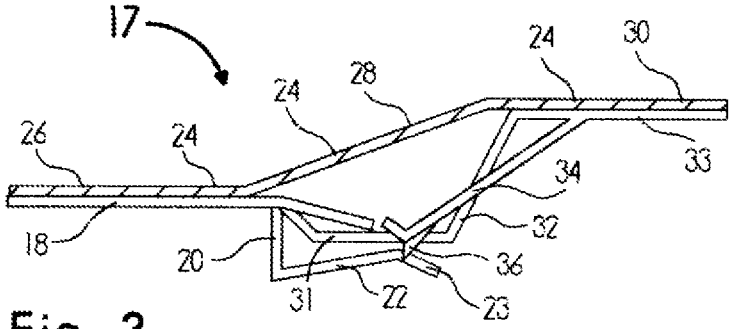
FIG. 3 shows a cross-sectional view of a slit receiver.

FIG. 3 shows an enlarged cross-sectional view of a slit receiver 17 in accordance with embodiments of the present invention. The slit receiver 17 comprises a base member 18. In one embodiment, the base member 18 is positioned adjacent and substantially parallel to the first rabbet 10 with a lip 20 extending at substantially a 90° angle from the base member 18 along the interior side of the abutment 8. The slit receiver 17 may be attached to the interior side of the first rabbet 10 by attaching the base member 18 to the first rabbet 10 using tacking, gluing, welding, or other fastening mechanisms.

Still referring to FIG. 3, at least one trim element guide 22 extends at an angle toward 31 from the lip 20 of the base member 18. In one embodiment, the trim element guide 22 can include a lead-in element 23 on the end of the trim element guide 22 opposite the lip 20, and the lead-in element 23 can be configured to accept the trim element 4 and direct the trim element 4 into the trim element guide 22. In one embodiment, the lip 20 can be substantially parallel to and offset from the interior side of the abutment 8.

Again referring to FIG. 3, at least one support bar 24 extends from the base member 18, with a first portion 26 of the support bar 24 attached to the base member 18, a second portion 28 rising at an angle between 0° and 90° away from but over the stop 6, and a third portion 30 substantially parallel to and offset from the first portion 26 and extending partially beyond the stop 6. The base member 18 can include a retainer 31 and a frame anchor 33. The retainer 31 can extend over and the trim element guide 22, providing a surface upon which the trim element 4 can contact when inserted into the slit receiver 17. The frame anchor 33 can extend beneath and parallel to the third portion 30 of the support bar 24, and can provide support to the slit receiver 17.

In some embodiments, the slit receiver 17 includes a foot member 32. In the embodiment shown in FIG. 3, the foot member 32 can extend from the frame anchor 33 towards the retainer 31. As shown in FIG. 3, the foot member 32 is angled so as to extend into the region between the second portion 28 and the stop 6 extending away from the stop 6 at an angle of between 0° and 90° relative to the surface of the stop 6.

The frame anchor 33 can also include at least one compressible prong 34, which can extend downward from the frame anchor 33 towards the stop 6. The compressible prong 34 can be configured to deflect upwards towards the second portion 28 of the support bar 24 when the trim element 4 is inserted into the slit receiver 17 in the space between the retainer 31 and the trim element guide 22. The terminal end of the compressible prong 34 can be bent slightly toward the stop 6, forming a prong lip 36 to catch a raised slit 38 (shown in FIG. 2) on the trim element 4 to help retain the trim element 4 in the slit receiver 17, as will be described in greater detail below.

Figure 4:
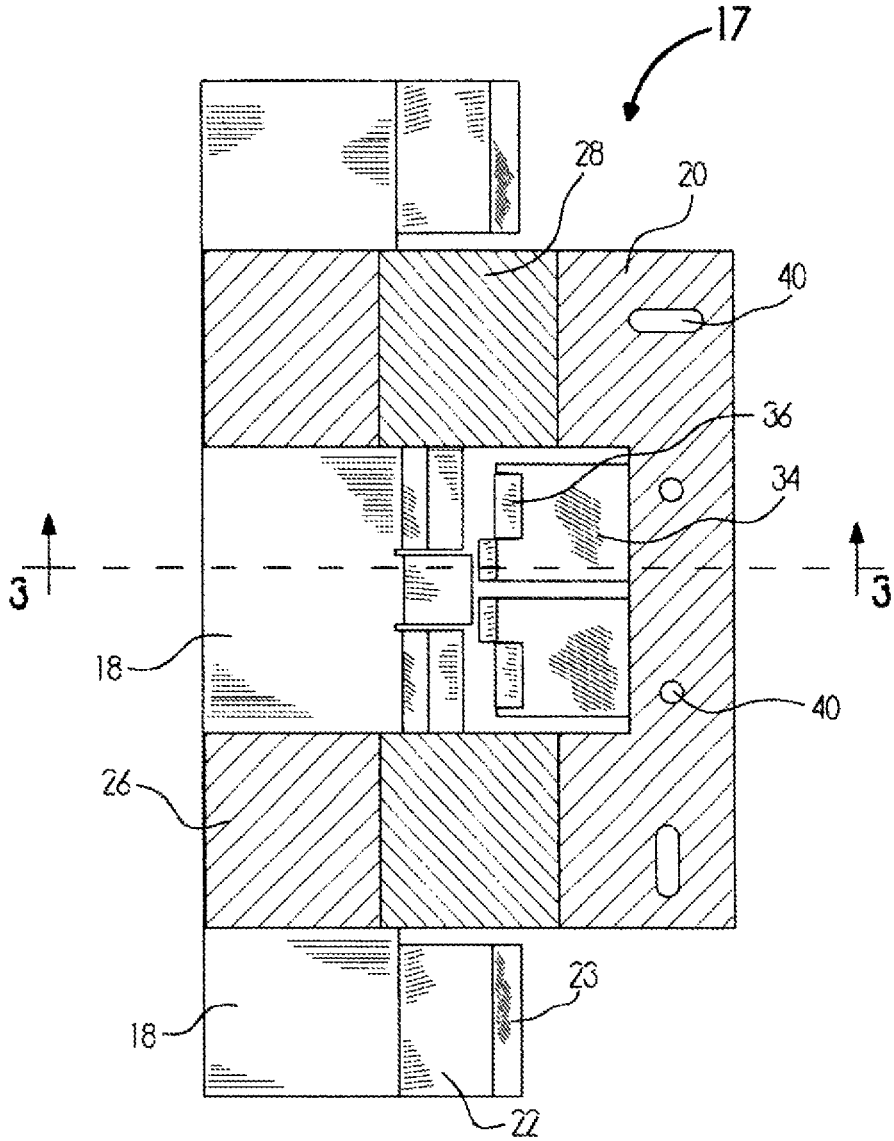
FIG. 4 shows a top view of the slit receiver depicted in FIG. 3.

As shown in the top view of the slit receiver 17 provided in FIG. 4, the slit receiver 17 can also be configured to provide mechanisms to allow the mounting element 2 to be attached to the wall opening. Any type of reversible attachment mechanism, preferably one that can be detached without damaging the mounting element 2 or trim element 4, can be used.

For example, still referring to FIG. 4, the third portion 30 of the support bar 24 can include one or more holes 40 configured to allow a screw, bolt or other fastener to extend through the hole 40 and into the wall opening material. The head of the screw or fastener contacts the third portion 30 of the support bar 24 and the frame anchor 33 when driven through the hole 40 and into the wall material, securely coupling the mounting element 2 to the wall opening. The holes 40 on the support bar 24 can be configured to allow the screw to be driven into the wall material at a range of angles to the surface of the wall.

FIG. 5 shows a side view of the mounting element 2 depicted in FIG. 1. Referring to FIG. 5, a removing key hole 42 can be provided in the mounting element 2 adjacent to the location where a slit receiver 17 has been attached to the mounting element 2. In one embodiment, the removing key hole 42 can be provided on the abutment 8 substantially across from the compressible prong 34 of the slit receiver 17. The removing key hole 42 forms an opening to receive a removing key 44 (shown in FIG. 6), as will be described in greater detail below. The number of removing key holes 42 can correspond to the number of slit receivers 17 attached to the mounting element 2. For example, if there are two slit receivers 17 on the strike jamb 100 and two slit receivers 17 on the hinge jamb 102, then four removing key holes 42 could be used.

The mounting element 2 may also be provided with cutouts to receive or couple to hinges, latches, dead bolts, and other components used for supporting, opening, closing, and locking the doors or windows to be installed in the frames. These cut-outs can be formed, for example, in the first rabbet 10, in locations similar to the locations used with conventional door frames, as would be understood by one of ordinary skill in the art.

The slit receiver 17 may be formed in a variety of ways. For example, one or more of the components of the slit receiver 17 can be formed as a separate component (shown in FIG. 11), and then fastened together to form the slit receiver 17. Alternatively, the slit receiver 17 may be formed out of a single piece of material. The entire slit receiver 17 makes up the mechanism with which the trim element 4 attaches to the mounting element 2. The slit receiver 17, trim element 4, and mounting element 2 can also include additional guides, lips, prongs, and support members that would allow for a sturdy design and easy detachment. The number of guides, lips, prongs, and support members may be influenced by the dimensions of the wall opening being framed and the individual needs of each framing job. The mounting element 2 may have one or more slit receivers 17 for coupling with the trim element 4. However, the slit receivers 17 can be positioned in a variety of places along the length of the mounting element 2, such as on the strike jamb 100, hinge jamb 102, and/or header 104 of the mounting element 2 to allow for diverse application.

In one embodiment, referring to FIG. 2, the trim element 4 can comprise multiple portions: a second rabbet 46, a second trim face 48, a second return 50, and a second double return 52. The second rabbet 46 can act as a spacer between the interior and exterior of the wall being framed and can be configured to include at least one raised slit 38. The second rabbet 46 can act as a support for the second trim face 48. The second return 50 can act as a component that prevents a gap between the second trim face 48 and the wall. The second double return 52 can act as support for the mounting element 2 to abut against the wall. In total, the trim element 4 depicted in FIG. 2 can be made up of components of a generic frame with the addition of at least one raised slit 38.

In one embodiment, on the interior surface of the second rabbet 46 distal from the second trim face 48, at least one raised slit 38 may be provided. The raised slit 38 can resemble a louver, with the upward end pointing toward the second trim face 48 and rising up from the plane of the interior side of the second rabbet 46, with the downward end pointing toward the terminal end of the second rabbet 46. The raised slit 38 can be configured to lockedly engage with the compressible prong 34 of the slit receiver 17 when the second rabbet 46 is inserted into the slit receiver 17 of the mounting element 2. When engaged, the raised slit 38 comes into contact with the prong lip 36 of the compressible prong 34, which fixedly couples the trim element 4 into the mounting element 2. Notably, the coupling between the prong lip 36 and the raised slit 38 is not permanent, and the trim element 4 may be non-destructively released from the slit receiver 17 by deflecting the compressible prong 34 away from the second rabbet 46, using the removing key 44 (FIG. 6).

In another embodiment not shown, multiple raised slits 38 are provided along the second rabbet 46 at varying distances from the second trim face 48. By providing multiple raised slits 38 at different distances, the compressible prong 34 may fixedly couple with a raised slit 38 at differing distances along the trim element 4. As a result, the installer of the door frame may select from a plurality of separation distances between the trim element 4 and the mounting element 2. This embodiment allows for finer tuning of the frames' depths.

Referring to FIG. 6, a removing key 44 can be inserted into the removing key hole 42 in the mounting element 2. In the illustrated embodiment, the removing key 44 comprises a blade portion 54 and a bow portion 56. The blade portion 54 comprises a flat, elongated shaft shaped so as to be received into the removing key hole 42. When the removing key 44 is inserted into the removing key hole 42, the distal end of the blade portion 54 extends to the prong lip 36 so as to apply force to the compressible prong 34 to cause the prong lip 36 to disengage from the raised slit 38. The illustrated embodiment of the bow portion 56 extends at approximately a right angle from the blade portion 54, so as to permit the installer to comfortably apply force to the flat face of the bow portion 56 to drive the distal end of the blade portion 54 into the key hole 42. The distal end of the blade portion 54 can be formed as a beveled distal end 58.

The components of the wall opening frame described herein can be made of a variety of materials. In one embodiment, the mounting element 2 and the trim element 4 are formed substantially out of steel or other durable metal or metal composite. The material can be painted or otherwise colored for aesthetic purposes or to diminish the effects of natural or manmade elements on the framing material. One embodiment of the present disclosure can be made by bending, rolling, or stamping a sheet of steel or other metal to create the shape of the mounting element 2 described above. The gauge of the sheet metal can vary depending on the use of the frames, and one having ordinary skill in the art will be able to determine what gauge of sheet metal to use for any particular application. The various portions of the mounting element 2 (i.e., the strike jamb 100, the hinge jamb 102, the header 104, and the slit receiver 17) can be formed of separate pieces of sheet metal welded together at the corners to form the complete mounting element 2. The sheet metal can be cut to the desired length and width, which one having ordinary skill in the art would be able to determine. The removing key hole 42 can be cut before or after the sheet metal is bent.

Similarly, the slit receiver 17 may also be formed using, for example, bending or stamping of sheet metal. In one embodiment, the slit receiver 17 can be one piece of metal, cut so that when the metal is bent into the shape described above, it contains the elements of the slit receiver 17. Holes 40 can be drilled or punched in the third portion 30 of the support bar 24 and the frame anchor 33 of the slit receiver 17 to allow the mounting element 2 to be attached to the wall opening material. Once cut and bent into the described shape, the slit receiver 17 can be attached to the interior portion of the mounting element 2. In one embodiment, the slit receiver 17 can be tacked to the interior side of the first rabbet 10.

In one embodiment, the trim element 4 can be made substantially the same way as the mounting element 2. In one embodiment, sheet metal can be cut to a desired length and bent into the shape described above and shown in FIG. 2. The raised slit 38 of the trim element 4 can be punched into the second rabbet 46 so that a portion of the metal closest to the second trim face 48 is raised above the interior plane of the second rabbet 46.

The removing key 44 can be made, in one embodiment, by cutting a piece of metal to approximately one and one-half the length of the stop 6, and with a width and depth that will allow the removing key 44 to fit within the removing key hole 42. In one embodiment, the piece of metal can then be bent at approximately a right angle to create the blade portion 54 and the bow portion 56. The blade portion 54 can be approximately the length of the stop 6 and the bow portion 56 can be approximately one-half the length of the stop 6. The distal end of the blade portion 54 can be beveled 58.

In use, once the mounting element 2 (with the slit receiver 17), the trim element 4, and the removing key 44 are made as described above, the present disclosure can be installed. In one embodiment, the strike jamb 100, hinge jamb 102, and header 104 of the mounting element 2 can be one continuous piece of metal; the same can be true for the trim element 4. In a wall opening meant for a door, an embodiment of the present disclosure can be installed first by measuring the door opening's height, width, and depth. Then, a mounting element 2 cut and bent for the size of the door opening can be placed in the opening with the third portion 30 of the support bar 24 substantially touching the interior portion of the door opening and the first return 14 or double return 16 substantially touching the wall outside of the door opening. If more than one slit receiver 17 is used, and if all of the support bars 24 do not touch the door opening, shims can be used to ensure that the door is properly spaced. The use of shims will be readily determinable to one having ordinary skill in the art.

In one embodiment, the mounting element 2 can then be attached to the door opening by driving screws or other fastener mechanisms through the holes 40 in the support bar 24 and the frame anchor 33 and into the door opening material. This process can be repeated until screws have been added to each slit receiver 17 and the mounting element 2 stands in the door opening free from assistance.

Next, the pre-cut and bent trim element 4 can be lined up with the mounting element 2 so that the raised slits 38 are substantially opposite the compressible prongs 34 of the slit receivers 17. Once lined up, the second rabbet 46 of the trim element 4 can be pushed between the retainers 31 and the trim element guides 22 of the slit receivers 17 until the raised slits 38 move past the compressible prongs 34, lockedly engaging the raised slits 38 with the compressible prongs 34 (FIG. 13). Due to the prong lips 36 on the compressible prongs 34 and the lip on the raised slits 38, the mounting element 2 and trim element 4 may not be able to disengage without the use of the removing key 44.

Once the frame has been installed using the above instructions, door hinges, latches, and locks can be installed. One having ordinary skill in the art will be able to determine how to install such hinges, latches, and locks. Then the door can be hung.

Figure 14:
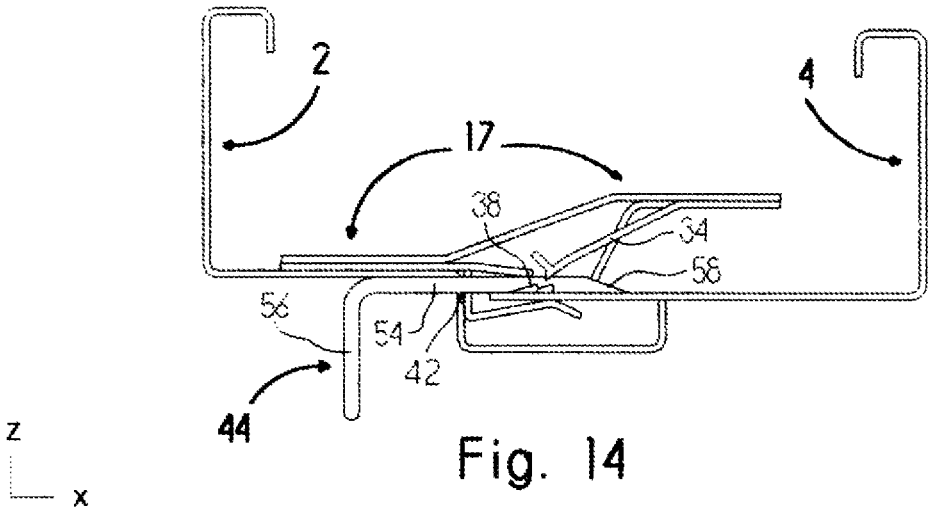
FIG. 14 shows a cross sectional view of a mounting element, a trim element and a slit receiver with a removing key engaged to release the trim element from the mounting element.

When removal of the frame is desired, in one embodiment of the present disclosure, the door can first be opened and unhinged to reveal the removing key holes 42. Next, removing keys 44 can be placed into each removing key hole 42. In one embodiment, the blade portion 54 of the removing keys 44 can be placed into the removing key holes 42, with the bow portion 56 extending inwards toward the center of the door opening. With applied force, such as by a hammer, the removing keys 44 can be driven into the removing key holes 42. By so doing, the beveled portion 58 of the removing key 44 compresses the compressible prongs 34 of the slit receiver 17 and disengages the raised slits 38 from the compressible prongs 34 (FIG. 14). All removing keys 44 can be pushed into removing key holes 42 to disengage the raised slits 38 from the compressible prongs 34.

With the removing keys 44 still in the removing key holes 42, the trim element 4 can be pulled or otherwise pried away from the mounting element 2. The trim element 4, having been removed, has not been damaged from the removal and can be set aside for reuse.

The removing keys 44 can then be removed from the removing key holes 42 by pulling the removing keys 44 away from the mounting element 2. This may require the use of leverage such as by a crowbar or the back side of a hammer.

The screws or other fastening mechanisms used to secure the mounting element 2 to the door opening are now visible and can be undone. In one embodiment, the screws can be unscrewed and used for future applications.

Once all of the fastening mechanisms have been undone, the mounting element 2 can be pulled off the door opening. The mounting element 2 has not been damaged from the removal and can be set aside for reuse. The only damage done to the door opening is the screw holes used to secure the mounting element 2 to the door opening.

While certain embodiments of the present disclosure have been disclosed in detail, it is to be understood that various modifications may be adopted without departing from the spirit of the disclosure.

Unless otherwise indicated, all numbers expressing quantities of ingredients used in the specification and claims are to be understood as being modified in all instances by the term "about." Accordingly, unless indicated to the contrary, the numerical parameters set forth in the specification and attached claims and embodiments are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

The terms "a," "an," "the" and similar referents used in the context of describing the invention are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventors expect skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above described elements in all possible variations thereof is encompassed by the invention unless otherwise indicated herein or otherwise clearly contradicted by context.

Specific embodiments disclosed herein may be further limited in the claims using consisting of or consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the invention so claimed are inherently or expressly described and enabled herein.

Furthermore, numerous references have been made to patents and printed publications throughout this specification. Each of the above-cited references and printed publications are individually incorporated herein by reference in their entirety.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

What is claimed is:

1. A removable wall opening frame, comprising: a trim element comprising an engaging portion; and a mounting element comprising a receiver configured to releasably engage the engaging portion of the trim element to couple the mounting element to the trim element; the receiver comprising a first portion and a third portion parallel to the first portion, and a slanted second portion connecting the first and third portion, a compressible prong extending from the third portion, the compressible prong having a horizontal part attached to the third portion and a slanted portion extending towards the first portion, the slanted portion having a lip that interacts with the engaging portion of the trim element to fixedly couple the trim element with the mounting element.

2. The wall opening frame of claim 1, wherein:

the mounting element is configured to include an interior portion and an exterior portion, and the receiver is positioned on the interior portion.

3. The wall opening frame of claim 1, wherein:

the receiver comprises at least one guide, wherein the at least one guide is configured to direct the engaging portion of the trim element into the receiver.

4. The wall opening frame of claim 1, wherein:

the mounting element comprises a stop, a first rabbet, and a first trim face;

the receiver is coupled to the first rabbet with a portion of the receiver extending over the stop; and the receiver comprises at least one compressible prong configured to engage the engaging portion of the trim element when the mounting element is coupled to the trim element.

5. The wall opening frame of claim 1, wherein:

the trim element comprises a second rabbet and a second trim face; and the second rabbet comprises at least one raised slit.

6. The wall opening frame of claim 5, wherein:

the trim element comprises a plurality of raised slits, wherein each raised slit is offset from adjacent raised slits so that each raised slit is a different distance from the second trim face.

7. The raised slit of claim 5, wherein:

the raised slit of the trim element is releasably engaged to the mounting element by the compressible prong of the receiver.

8. A removable wall opening frame, comprising: a mounting element comprising a mounting portion for coupling the mounting element to a wall opening; and a trim element configured to releasably engage the mounting element such that when the trim element is engaged with the mounting element, the mounting portion is covered by the trim element; wherein the mounting element comprises a receiver, the receiver comprising a first portion and a third portion parallel to the first portion, and a slanted second portion connecting the first and third portion, a compressible prong extending from the third portion, the compressible prong having a horizontal part attached to the third portion and a slanted portion extending towards the first portion, the slanted portion having a lip that interacts with the engaging portion of the trim element to fixedly couple the trim element with the mounting element.

9. The wall opening frame of claim 8, wherein:

the mounting element is configured to include an interior portion and an exterior portion, and the receiver is positioned on the interior portion.

10. The wall opening frame of claim 9, wherein:

the mounting element comprises a stop, a first rabbet, and a first trim face;

the receiver is coupled to the first rabbet with a portion of the receiver extending over the stop; and the receiver comprises at least one compressible prong configured to engage the trim element when the mounting element is coupled to the trim element.

11. The wall opening frame of claim 8, further comprising:

the trim element comprises at least one second rabbet and at least one second trim face; and the at least one second rabbet comprises at least one raised slit.

12. The wall opening frame of claim 11, further comprising:

the trim element comprises a plurality of raised slits, wherein each raised slit is offset from adjacent raised slits so that each raised slit is a different distance from the second trim face.

13. A removable wall opening frame, comprising: a trim element comprising an engaging portion; a mounting element comprising a receiver configured to releasably engage the engaging portion of the trim element; a key opening on the mounting element adjacent the receiver; and a key, sized so as to disengage the engaging portion from the receiver when the key is inserted into the key opening; the receiver comprising a first portion and a third portion parallel to the first portion, and a slanted second portion connecting the first and third portion, a compressible prong extending from the third portion, the compressible prong having a horizontal part attached to the third portion and a slanted portion extending towards the first portion, the slanted portion having a lip that interacts with the engaging portion of the trim element to fixedly couple the trim element with the mounting element.

14. The wall opening frame of claim 13, wherein:

the trim element is configured to include at least one raised slit; and the receiver is configured to engage the at least one raised slit on the trim element to releasably form the wall opening frame.

15. The wall opening frame of claim 13, wherein:

the trim element comprises a plurality of two sets of raised slits positioned along a second rabbet to align with each receiver of the mounting element, wherein one set of raised slits is offset from adjacent set of raised slits so that each set of raised slits is a different distance from a second trim face.

16. The wall opening frame of claim 13, wherein:

the key is configured to have a blade portion and a bow portion;

the blade portion is configured to have a beveled distal end; and the bow portion is configured to permit the application of force to the key in the direction of the distal end of the blade portion.

* * * * *